US011780714B2

(12) United States Patent
Huang

(10) Patent No.: US 11,780,714 B2
(45) Date of Patent: Oct. 10, 2023

(54) INTEGRATED STRUCTURE OF POWER SOURCE OF POWER WINCH AND ELECTRIC CONTROL BOX

(71) Applicant: Comeup Industries Inc., New Taipei (TW)

(72) Inventor: Shih Jyi Huang, New Taipei (TW)

(73) Assignee: Comeup Industries Inc., New Taipei (TW)

( * ) Notice: Subject to any disclaimer, the term of this patent is extended or adjusted under 35 U.S.C. 154(b) by 9 days.

(21) Appl. No.: 17/511,816

(22) Filed: Oct. 27, 2021

(65) Prior Publication Data

US 2023/0127189 A1 Apr. 27, 2023

(51) Int. Cl.
*B66D 1/12* (2006.01)
*B66D 1/48* (2006.01)

(52) U.S. Cl.
CPC ..... *B66D 1/485* (2013.01); *B66D 1/12* (2013.01)

(58) Field of Classification Search
CPC ... B66D 3/20; B66D 3/26; B66D 1/12; B66D 1/14; B66D 1/485; B66D 2700/0141; B66D 2700/0183
See application file for complete search history.

(56) References Cited

U.S. PATENT DOCUMENTS

2008/0001132 A1* 1/2008 Huang ..... B66D 1/12 254/362
2015/0307332 A1* 10/2015 Huang ..... B66D 1/12 254/323
2016/0145084 A1* 5/2016 Huang ..... B60S 9/08 254/103
2019/0077642 A1* 3/2019 Huang ..... H02H 3/006
2021/0316972 A1* 10/2021 Huang ..... B66D 1/00
2021/0332884 A1* 10/2021 Huang ..... F16H 63/3026

FOREIGN PATENT DOCUMENTS

DE 102020111283 A1 * 10/2021
WO WO-2022156839 A1 * 7/2022

* cited by examiner

*Primary Examiner* — Emmanuel M Marcelo

(57) ABSTRACT

In an integrated structure of a power source of a power winch and an electric control box, the electric control box of the power winch is integrally combined with the top of the power source by a support frame, and an outer cover is provided for axially covering the electric control box and the power source and locked and connected to a front shell wall, so that the electric control box and the power source are completely hidden in the outer cover without any exposure. In other words, the electric control box is combined with the power source by a hidden assembly mode, so that the electric control box can be securely assembled without any risk of being shaken or falling off. In the meantime, the electric control box is hidden in the outer cover, and thus it will not be affected by weather at all.

3 Claims, 6 Drawing Sheets

INTEGRATED STRUCTURE OF POWER SOURCE OF POWER WINCH AND ELECTRIC CONTROL BOX

BACKGROUND OF THE INVENTION

Field of the Invention

The present invention relates to an integrated structure of a power source of a power winch and an electric control box, and more particularly to a power winch capable of combining and installing an electric control box to a winch host stably, and maintaining the electric control box in a condition not affected by weather.

Description of the Related Art

Power winch is a power tool used to hang and move a load up and down or drag the load to a nearer or farther position. In a common example, a hoist installed at a tall building for hoisting and vertically elevating heavy loads or goods is a power winch, or a rope hoist installed onto a jeep or an off-road vehicle for towing other vehicles for self-rescue (or escape) rope is also a power winch. In the operating principle of the power winch, a power source (such as a power motor or an electric motor) outputs a power to control and change the transmission in a forward direction or a reverse direction. After a deceleration mechanism is operated, a rope wheel is driven to perform a forward rotation or a reverse rotation to release or retract a rope (including but not limited a wire rope or a synthetic rope), and a front end of the rope (wire rope or synthetic rope) has a hoist hook for hooking a load (such as a heavy object, another car, or another object, etc.) in order to move the load. Since the deceleration mechanism must accept the transmission of the power source and the rope wheel must accept the transmission of the deceleration mechanism, and the rope must be wound on the rope wheel, therefore the power source, the deceleration mechanism, the rope wheel and the wheel, therefore the power source, the deceleration mechanism, the rope wheel and the rope are coupled together by a support frame to form a "winch host" when the winch host is installed, the power source, the deceleration mechanism, the rope wheel, the rope and the support frame are locked together to a selected position.

At present, the power winch is mainly operated in a remote mode, so that the power winch must be equipped with an electric control box and a remote control, and the electric control box is electrically coupled to the power source of the winch host and the remote control, and the transmission of signals between the remote control and the electric control box may be performed in a wireless remote control mode or a cable remote control mode selectively. The electric control box mainly receives a control signal transmitted from the remote control and further controls the ON/OFF of the power source and control a rotating direction and a rotation speed for outputting the force of the power source.

In order to satisfy the DIY requirement of users (or drivers), the conventional power winch has an electric control box fixedly mounted onto the winch host and exposed from the winch host, so that the users can see the assembly or connection between the electric control box and the winch host at a glance, while the user instruction manual will clearly describe how to disconnect the electric control box from the winch host, and then reconnect electric control box and the winch host correctly after they are installed to selective proper positions respectively. In this way, the invention takes the needs for safety and correct assembly into consideration, in addition to satisfying the needs for DIY of the users.

In general, the electric control box is mounted onto and exposed from the winch host, and thus the assembly is simple, but the electric control box is exposed to the outside and may be damaged easily by weather. If a user has not removed the electric control box and installed in an appropriate position, and jointly install the electric control box with the winch host to the bumper of a vehicle, then the electric control box may be damaged or broken down easily.

SUMMARY OF THE INVENTION

In view of the aforementioned drawbacks of the conventional power winch, the inventor of the present invention adopted a hidden assembly mode to combine the electric control box with the winch host for the users who do not like DIY, and achieve the effect of providing a secured assembly without being affected by weather.

Therefore, it is a primary objective of the present invention to provide a power winch that can combine an electric control box with a winch host stably and achieve the effect of not being affected by weather.

To achieve the above-mentioned objective, the present invention is to provide an integrated structure of a power source of a power winch and an electric control box, the power winch comprising a power source, for outputting a power to transmit a deceleration device and driving a rope wheel to perform a forward rotation or a reverse rotation in order to release or retract a rope, and the rope wheel being transversally disposed at a central position of a support frame, and the power source being mounted on a side of the support frame, and the deceleration device being mounted on the other side of the support frame, and an electric control box, electrically coupled to the power source, for controlling the ON or OFF of the power source and a force output direction of the power source, characterized in that the top of the electric control box is locked and coupled to a support frame, the support frame and locked and coupled to the top of the power source, so that the electric control box is coupled to the top of the power source, and a front end of the power source is coupled to a wall of the support frame by a front shell wall, and the power source is locked and coupled to the front shell wall again, and the periphery of the electric control box and the power source is axially covered by an outer cover and locked and coupled to the front shell wall to define a status that the outer cover and the front shell wall cover the electric control box and the power source therein.

According to the above-mentioned integrated structure of a power source of a power winch and an electric control box, the electric control box and the power source are coupled to each other by a plurality of electrical connectors to achieve an electrical connection relationship between the electric control box and the power source.

According to the above-mentioned integrated structure of a power source of a power winch and an electric control box, the outer cover has a plug-in hole reserved at the top thereof and provided for plugging in a plug of a wired remote controller.

DETAILED DESCRIPTION OF THE PREFERRED EMBODIMENTS

The objectives, technical measures and effects of the present invention will become clearer in light of the following detailed description of an illustrative embodiment of this invention described in connection with the drawings.

Figure 1:
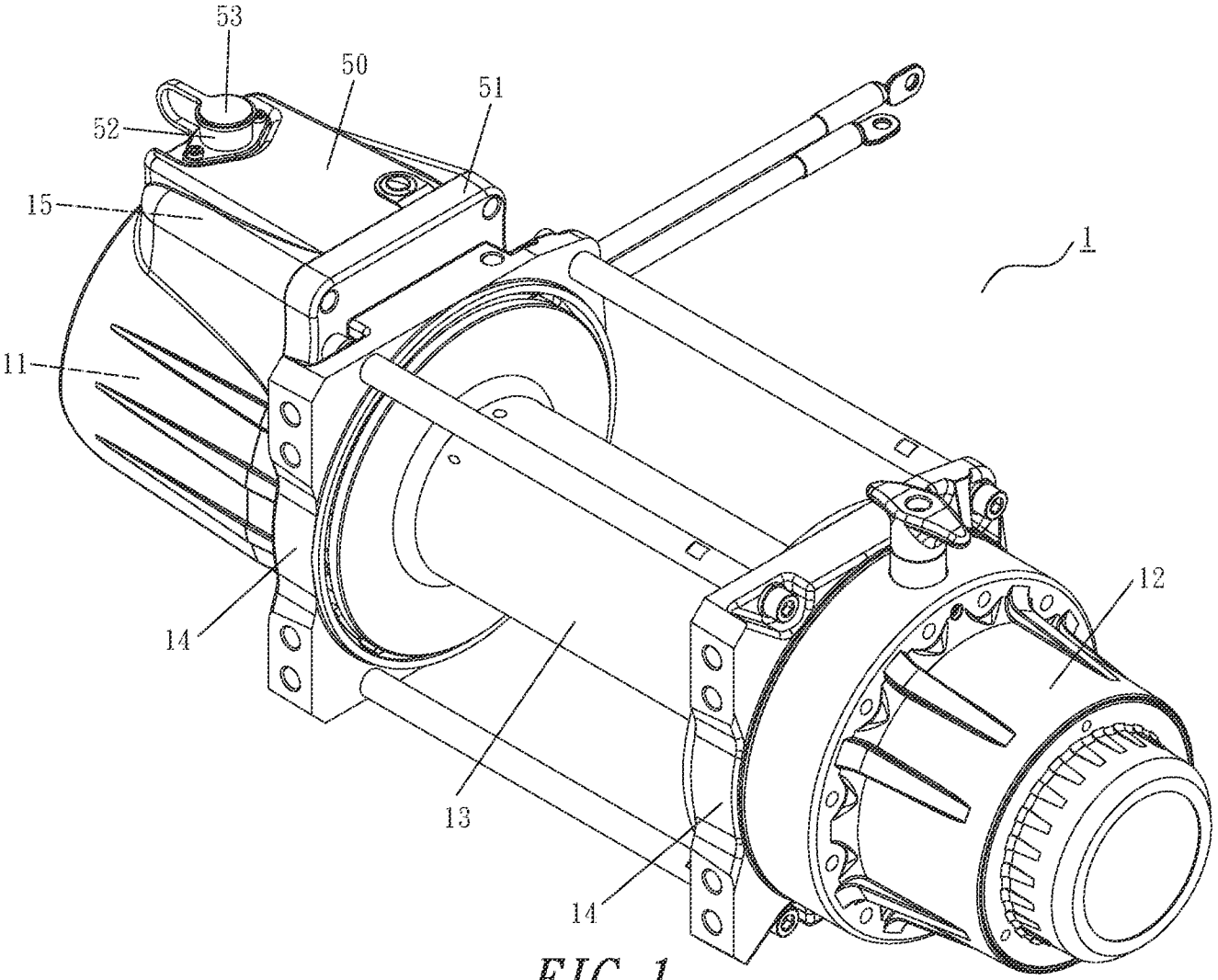
FIG. 1 is a perspective view of the present invention.
Figure 2:
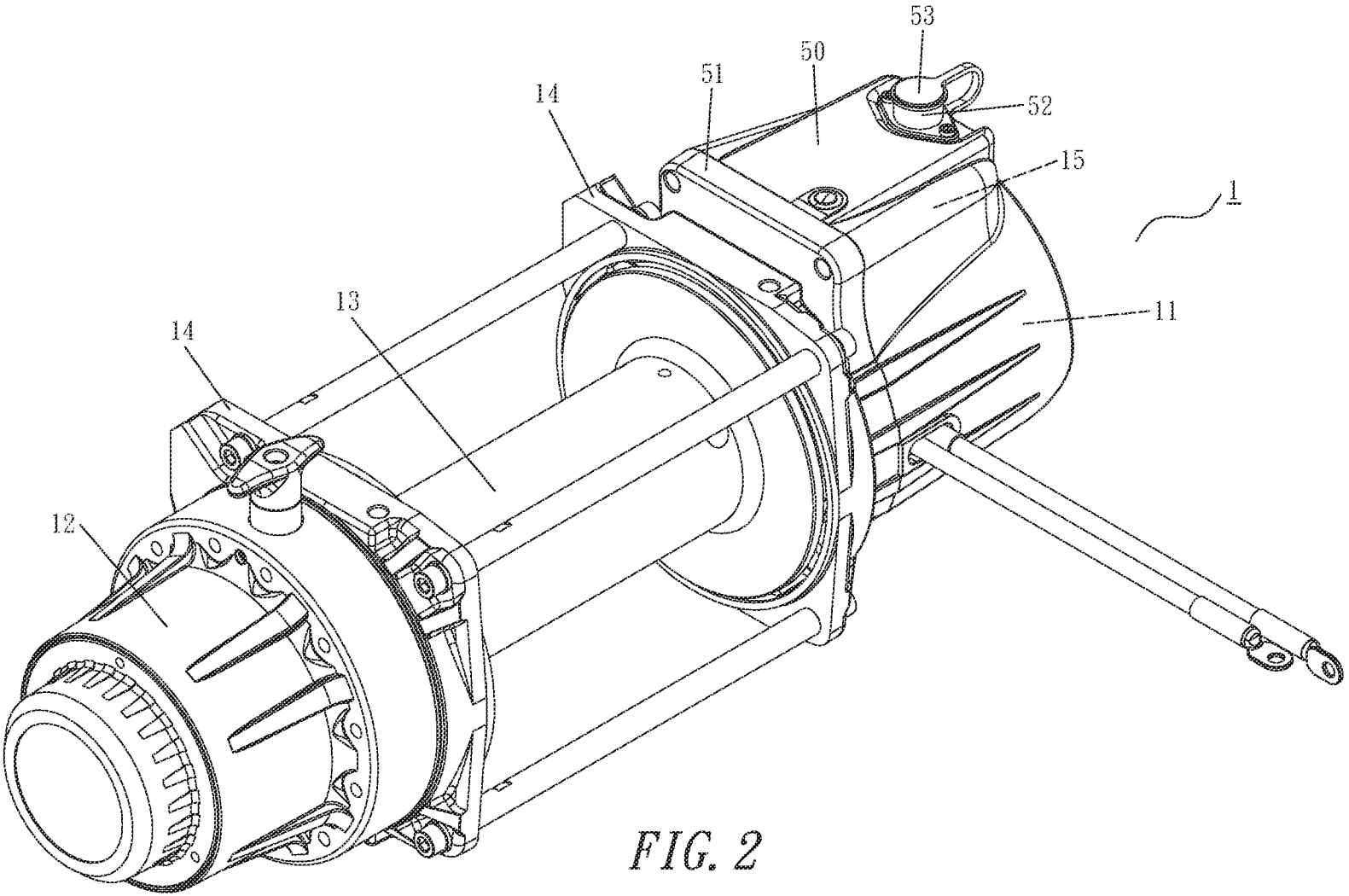
FIG. 2 is another perspective view of the present invention.

With reference to FIGS. 1 and 2 for a power winch 1 in accordance with an embodiment of the present invention, the power winch 1 includes a power source 11 (such as a power motor, an electric DC motor, etc.), and after the power outputted by the power source 11 is transmitted to an deceleration device 12 to drive a rope wheel 13 to perform a forward rotation or a reverse rotation in order to release or retract a rope, when needed. For simplicity, the rope is not shown in the figures, the rope wheel 13 is disposed transversally at the central position of a support frame 14, the power source 11 is mounted on a side of the support frame 14, the deceleration device 12 is mounted on the other opposite side of the support frame 14, the power transmission between the power source 11 and the deceleration device 12 is passed without touching through the interior of the cylinder shaft of the rope wheel 13, and then the deceleration device 12 substantially drives the whole rope wheel 13 to rotate, and the rope wheel 13 and the support frame 14 are connected with each other by a bearing to achieve the effect of maintaining the support frame 14 stably unmoved during the rotation of the rope wheel 13, and the power source 11, the deceleration device 12, the rope wheel 13, the rope and the support frame 14 form a "winch host".

Figure 3:
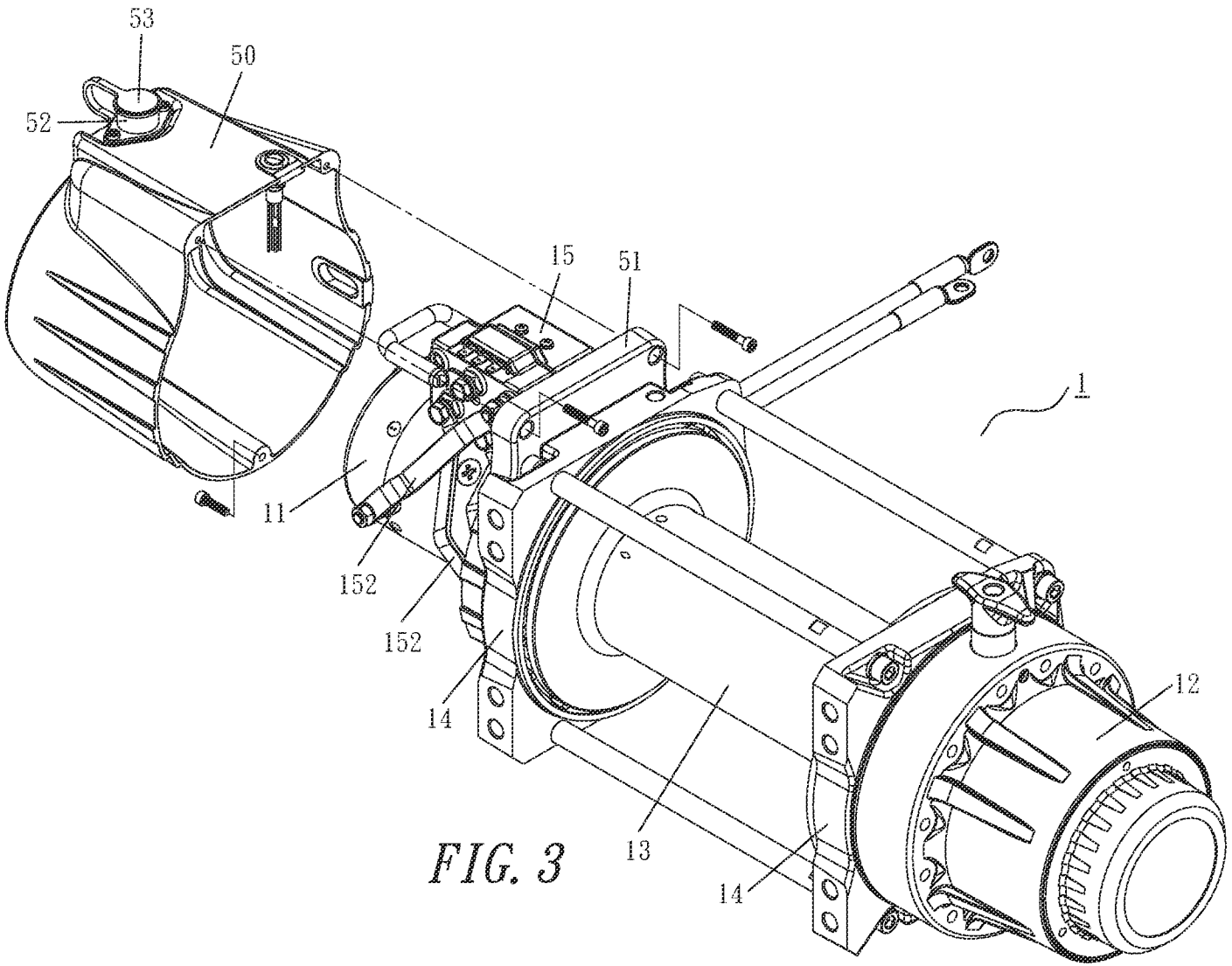
FIG. 3 is a first exploded view of the present invention, showing that an outer cover is disassembled.
Figure 4:
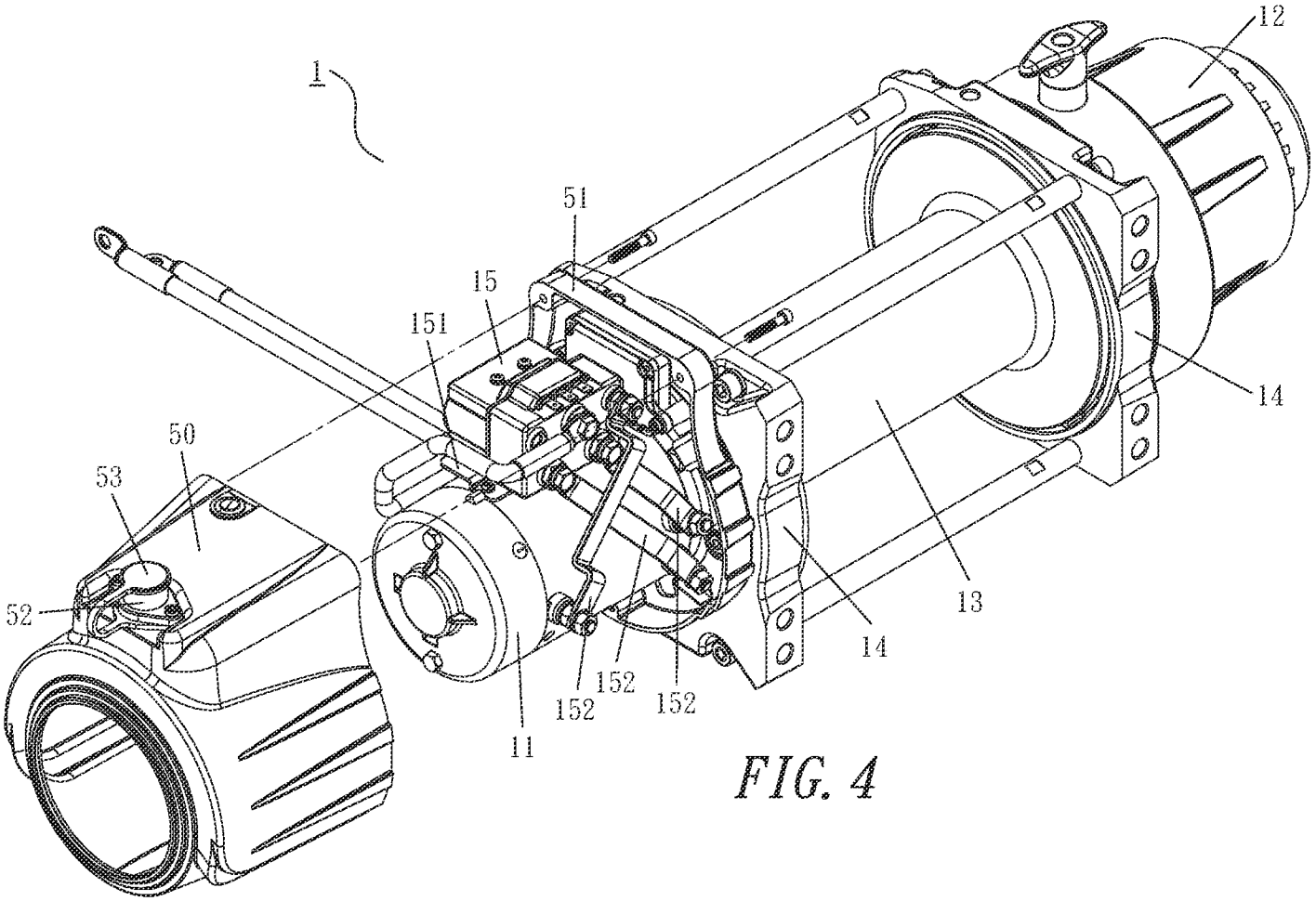
FIG. 4 is a second exploded view of the present invention, showing that an outer cover is disassembled.
Figure 5:
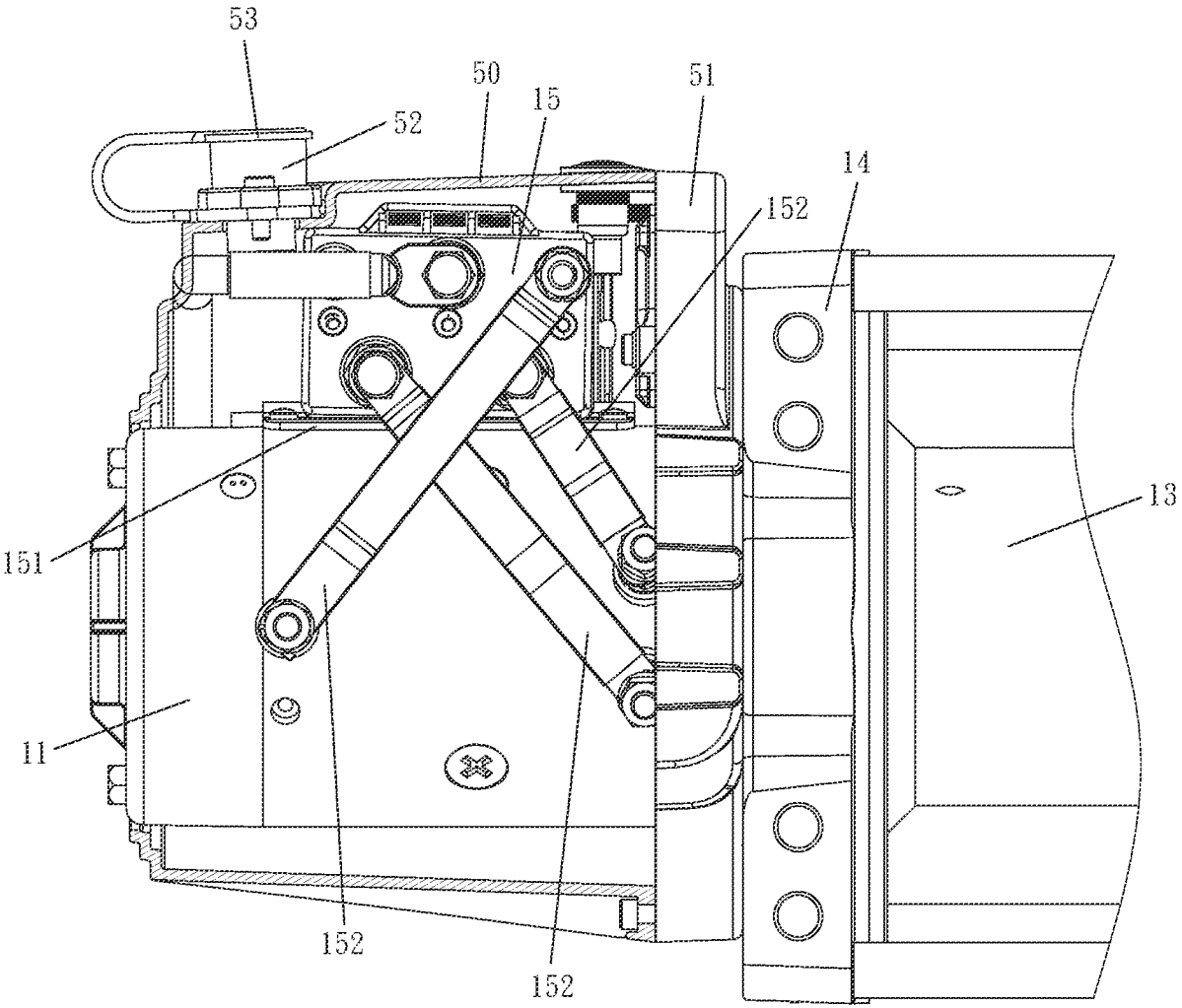
FIG. 5 is a partial cross-sectional side view of an outer casing in accordance with the present invention.
Figure 6:
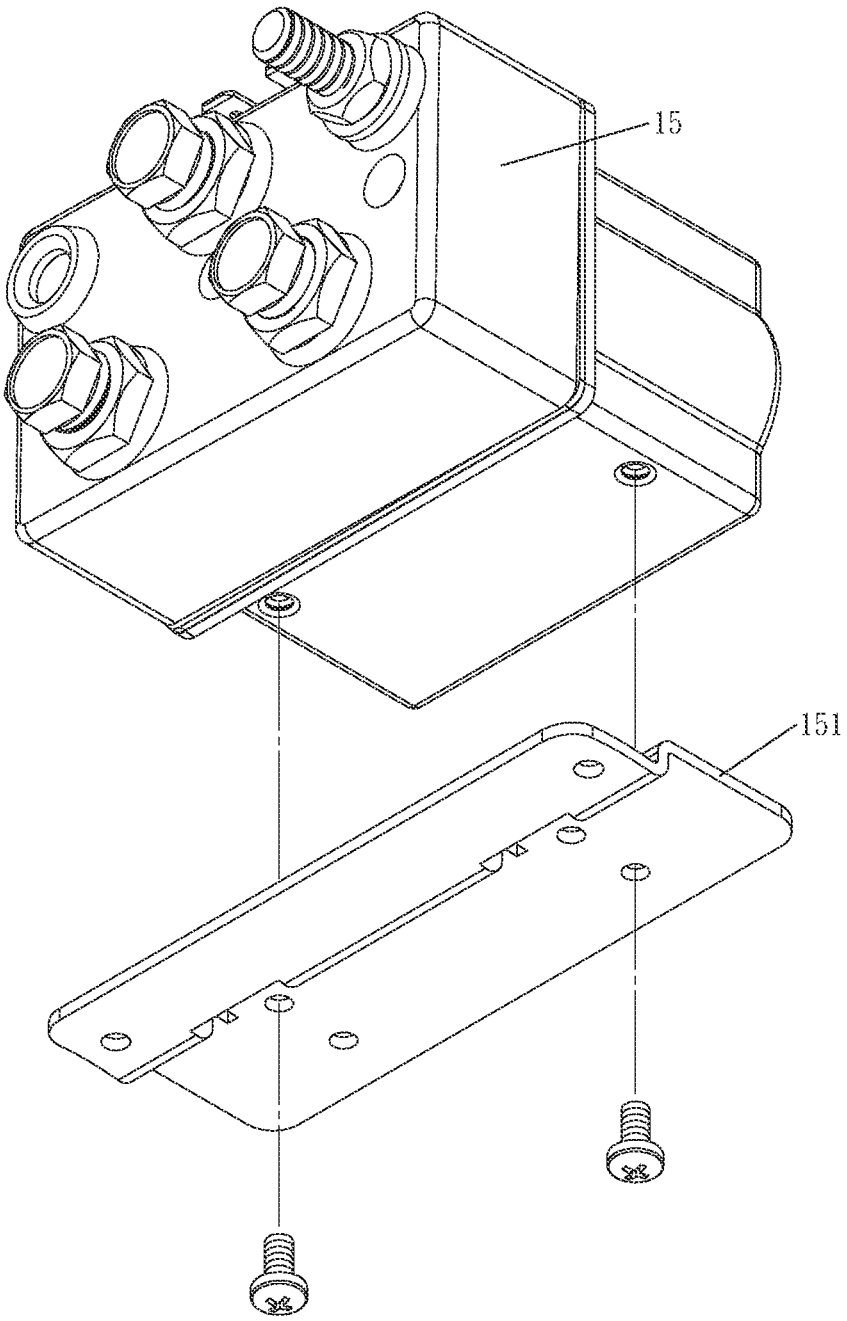
FIG. 6 is an exploded view of an electric control box in a support frame in accordance with the present invention.

In FIGS. 3 and 4, the front end of the power source 11 is fixedly connected to a sidewall of the support frame 14 by a front shell wall 51, and the power source 11 is locked onto the front shell wall 51, so as to define a relationship status that the front shell wall 51 supports the power source 11, and then the top of power source 11 is connected to an electric control box 15, as shown in FIGS. 5 and 6, and the bottom of the electric control box 15 is locked and connected to a support frame 151, and the support frame is also locked and connected to the top of the power source 11, so that the electric control box 15 is directly locked with the top of the power source 11 and integrated with the power source 11 as a whole. In FIG. 5, the electric control box 15 and the power source 11 are connected with each other by a plurality of electrical connectors 152, so that the electric control box 15 and the power source 11 are electrically connected. After the electric control box 15 and the power source 11 are combined, the external periphery axially cover the electric control box 15 and the power source 11 by an outer cover 50, and the outer cover 50 is locked and connected with the front shell wall 51 to define the status that the outer cover 50 and the front shell wall 51 simultaneously cover the electric control box 15 and the power source 11 therein. A plug-in hole 52 is reserved at the top of the outer cover 50, and a plug-in rod is disposed in the plug-in hole 52 and electrically connected with the electric control box 15, and the plug-in hole 52 is provided for plugging a plug of a wired remote controller (not shown in the figure), so that the wired remote controller and the electric control box 15 can be electrically connected. When the plug-in hole 52 is not in use, the slot of the plug-in hole can be covered by a cover 53. Before use, it is necessary to open the cover 53 to expose the slot of the plug-in hole 52.

The major improvement of the present invention resides on that the electric control box 15 is locked to the top of the power source 11 by the support frame 151 and integrated with the power source 11 as a whole, and an outer cover 50 is provided to axially cover the electric control box 15 and the power source 11, and the outer cover is locked and connected to a front shell wall, so that the electric control box 15 is completely hidden in the outer cover 50 without any exposure. In other words, the electric control box 15 is combined with the power source 11 of the winch host in a hidden assembly mode, so that the electric control box 15 can be stably assembled without any risk of being shaken or falling off. Since the electric control box 15 is hidden in the outer cover 50, the electric control box 15 will not be affected by weather at all.

In summation of the description above, the integrated structure of a power source of a power winch and an electric control box in accordance with the present invention is novel and can really achieve the expected creative purpose. Apparently, the invention complies with patent application requirements, and is thus duly filed for patent application.

What is claimed is:

1. A power winch comprising:

a power source, configured to output power to transmit to a deceleration device and to drive a rope wheel to perform a forward rotation or a reverse rotation in order to release or retract a rope, the rope wheel being transversally disposed at a central position of a support frame, the power source being mounted on a first side of the support frame, and the deceleration device being mounted on a second side of the support frame opposite to the first side, and an electric control box, electrically coupled to the power source, configured to control ON or OFF of the power source and a force output direction of the power source, wherein a top of the electric control box is locked and coupled to a second support frame, the second support frame is locked and coupled to a top of the power source, so that the electric control box is coupled to the top of the power source, and a front end of the power source is coupled to a wall of the first support frame by a front shell wall, the power source is locked and coupled to the front shell wall, and a periphery of the electric control box and the power source is axially covered by an outer cover and locked and coupled to the front shell wall, wherein the outer cover and the front shell wall cover the electric control box and the power source therein.

2. The integrated structure of a power source of a power winch and an electric control box according to claim 1, wherein the electric control box and the power source are coupled to each other by a plurality of electrical connectors to achieve an electrical connection relationship between the electric control box and the power source.

3. The integrated structure of a power source of a power winch and an electric control box according to claim 1, wherein the outer cover has a plug-in hole reserved at a top thereof and provided for plugging in a plug of a wired remote controller.

* * * * *